US008197101B2

(12) United States Patent
Kokado et al.

(10) Patent No.: US 8,197,101 B2
(45) Date of Patent: Jun. 12, 2012

(54) REFLECTOR FOR USE IN LIGHT EMITTING DEVICE AND LIGHT EMITTING DEVICE USING THE SAME

(75) Inventors: Haruo Kokado, Himeji (JP); Yoshihiro Shimoda, Himeji (JP)

(73) Assignee: Phoenix Electric Co. Ltd., Hyogo (JP)

( * ) Notice: Subject to any disclaimer, the term of this patent is extended or adjusted under 35 U.S.C. 154(b) by 272 days.

(21) Appl. No.: 12/633,348

(22) Filed: Dec. 8, 2009

(65) Prior Publication Data

US 2010/0142208 A1 Jun. 10, 2010

(30) Foreign Application Priority Data

Dec. 9, 2008 (JP) ..... 2008-313403

(51) Int. Cl.
*F21V 7/07* (2006.01)
*F21V 7/00* (2006.01)

(52) U.S. Cl. ..... 362/296.07; 362/297; 362/302; 362/347; 362/348; 362/350

(58) Field of Classification Search ..... 362/296.07, 362/297, 302, 348, 347, 350
See application file for complete search history.

(56) References Cited

U.S. PATENT DOCUMENTS

| | | | | |
|---|---|---|---|---|
| 5,568,967 | A * | 10/1996 | Sikkens et al. | 362/328 |
| 7,108,412 | B2 * | 9/2006 | Ishida et al. | 362/518 |
| 7,188,975 | B2 * | 3/2007 | Gorres | 362/297 |
| 7,223,000 | B2 | 5/2007 | Yamamura | |
| 7,270,449 | B2 * | 9/2007 | Uke | 362/350 |
| 7,306,352 | B2 * | 12/2007 | Sokolov et al. | 362/341 |
| 7,470,042 | B2 | 12/2008 | Ayabe et al. | |
| 7,517,115 | B2 * | 4/2009 | Van De Poel | 362/297 |
| 7,794,120 | B2 * | 9/2010 | Wong et al. | 362/348 |
| 7,824,076 | B2 * | 11/2010 | Koester | 362/294 |
| 7,832,905 | B2 * | 11/2010 | Kittelmann et al. | 362/296.07 |
| 2003/0185012 | A1 * | 10/2003 | Sitzema et al. | 362/328 |
| 2007/0279908 | A1 * | 12/2007 | Alcelik | 362/283 |

FOREIGN PATENT DOCUMENTS

| | | | |
|---|---|---|---|
| EP | 1035370 | A2 | 9/2000 |
| EP | 1632713 | A1 | 3/2006 |
| EP | 2009345 | A2 | 12/2008 |
| JP | 2006-073532 | | 3/2006 |
| JP | 2006-222413 | | 8/2006 |
| JP | 2006-338985 | | 12/2006 |
| JP | 2007-101732 | A | 4/2007 |

OTHER PUBLICATIONS

The European Search Report from the European Patent Office dated Jul. 26, 2011 for European patent application 09252163.2.

* cited by examiner

*Primary Examiner* — Thomas M. Sember
*Assistant Examiner* — David J Makiya
(74) *Attorney, Agent, or Firm* — Lucas & Mercanti, LLP

(57) ABSTRACT

A concave reflecting surface of a reflector for use in a light emitting device has micro reflector segments protruded therefrom in multiple stages and in multiple radial columns, the micro reflector segments each having a convex curved surface which is defined by a locus of a circular arc moved in parallel in a radial direction of the concave reflecting surface, and a radius of the convex curved surface, in each of the reflection regions, is set to be smaller when the convex curved surface is positioned closer to a point on which light emitted from each of the directional light sources and traveling on the light axis is incident, and is set to be larger when the convex curved surface is positioned more distant from the point.

8 Claims, 11 Drawing Sheets

REFLECTOR FOR USE IN LIGHT EMITTING DEVICE AND LIGHT EMITTING DEVICE USING THE SAME

BACKGROUND OF THE INVENTION

1. Field of the Invention

The present invention relates to a reflector for use in a light emitting device, the reflector having a concave reflecting surface capable of reflecting light emitted from a plurality of directional light sources and of forming a uniformly irradiated surface, and also relates to a light emitting device using the reflector.

2. Description of the Background Art

As a light emitting device used for general illumination and a projector, a combination of a reflector having a concave reflecting surface and a discharge lamp is widely used.

However, the discharge lamp needs large power consumption and has large heat discharge. Thus, a light emitting diode (LED) has been proposed to be used as a light source of a light emitting device, since the LED needs less power consumption and has less heat discharge, and besides, an amount of light emission per LED is being increased in recent years. However, even if the amount of light emission is increased, the amount of light emission per one unit is still smaller than that of the discharge lamp, and in order to cover this disadvantage of the LED, a light emitting device having a plurality of LEDs is developed so as to emit a larger amount of light (for example, patent document 1: Japanese Laid-Open Patent Publication No. 2007-101732).

As shown in FIG. 14A, light emitting device 1 according to patent document 1 includes two LEDs 2, and a reflector 4 having a concave reflecting surface 3. The concave reflecting surface 3 has two half paraboloids 5 located side by side having a space therebetween. Each of the LEDs 2 is arranged at a focal point F of its corresponding half paraboloid 5, and emits light such that a light axis L thereof is oriented toward the center of the half paraboloid 5.

According to the light emitting device 1, light beams emitted from the respective LEDs 2 are reflected on the corresponding half paraboloids 5, and are outputted, as parallel light beams, from the light emitting device 1. Thus, when the two LEDs 2 are turned on simultaneously, the amount of light emission can be doubled.

In the light emitting device 1, it is possible to increase the amount of light emission as above described, however, on an irradiation target surface A, the same number of bright circular portions X as the LEDs 2 are formed by the parallel light beams from the half paraboloids 5, and a majority portion of the irradiation target surface A is covered with the bright circular portions X, and a dark portion Y is generated on the remaining portion. Accordingly, a difference between bright and dark portions, caused by a light distribution pattern, on the irradiation target surface A is increased, which leads to a problem since the irradiation target surface A cannot be irradiated uniformly.

This is because, as shown in FIG. 5, each LED 2 is a directional light source that emits light such that a light beam traveling on a light axis L (that is, a light distribution angle =0) has maximum intensity, and a light beam traveling at an wider angle relative to the light axis L has smaller intensity. As shown in FIG. 14, light L1, which travels on the light axis L, is reflected on the half paraboloid 5, and irradiates a point X1 (a point irradiated by light reflected at an intersection between the light axis L and the half paraboloid 5), has the maximum light intensity, whereas the light intensity is decreased when the light irradiates a point that is more distant from the point X1 on the irradiation target surface A.

In order to irradiate the irradiation target surface A uniformly, patent document 2 (Japanese Laid-Open Patent Publication No. 2006-73532) discloses a technique of convexly arranging, on a concave reflecting surface of a reflector, a large number of micro reflector segments each having a surface curved with a predetermined curvature radius toward an inner space of the reflector.

The reflector disclosed in patent document 2 uses, as a light source, a light emitting element such as a halogen lamp, which is obtained by spirally winding a filament so as to form a cylindrical shape. That is, a light emitting element having a certain length is arranged so as to protrude from a central portion of the reflector. Light having uniform intensity radiated from the halogen lamp toward the entire circumference and reflected on the concave reflecting surface. The light beams are reflected at certain angles and then diffused, respectively, on a large number of micro reflector segments which are arranged on the concave reflecting surface and are each curved with a predetermined curvature radius. As a result, the diffused light beams are mixed together, which increases a uniformity ratio of the light intensity on the irradiation target surface A.

However, even if the technique disclosed in patent document 2 is applied to the light emitting device 1, which includes a plurality of LEDs as the directional light source disclosed in patent document 1. It is not able to sufficiently improve the uniformity ratio of the light intensity on the irradiation target surface A.

This is because the curved radius of the micro reflector segments on the reflector disclosed in patent document 2 is fixed, and a degree of diffusion of the light caused by the micro reflector segments is uniform at any point on the concave reflecting surface. Accordingly, both of the light L1 traveling on the light axis L and having strong intensity and light having weak intensity (e.g., light traveling at an angle of 90 degrees relative to the light axis L) are diffused in a similar manner, resulting in creation of the "bright circular portion X" and the "dark portion Y" on the irradiation target surface A.

SUMMARY OF THE INVENTION

The present invention is invented in view of the above-described problems of the conventional art. Thus, a main subject of the present invention is to provide a reflector for use in a light emitting device, and a light emitting device using the reflector, which are capable of sufficiently reducing a difference between bright and dark portions caused by a light distribution pattern on an irradiation target surface when light emitted from a plurality of directional light sources is reflected, and of sufficiently improving uniformity of light intensity on the irradiation target surface.

As shown in FIG. 2 (*b*), a first aspect of the invention is directed to a reflector 12 for use in a light emitting device 10, the reflector 12 comprises a concave reflecting surface 20 including a plurality of reflection regions S1, S2, which are arranged so as to correspond to a plurality of directional light sources 26*a*, 26*b*, each of whose light has maximum intensity on its light axis L, and has gradually decreased intensity at a wider angle relative to the light axis L, wherein: the concave reflecting surface 20 has micro reflector segments 29 protruded therefrom in multiple stages and in multiple radial columns, the micro reflector segments 29 each having a convex curved surface 29*a* which is defined by a locus of a circular arc moved in parallel in a radial direction of the concave reflecting surface 20; and the convex curved surface 29*a* has a radius R, in each of the reflection regions S1, S2, is set to be smaller when the convex curved surface 29*a* is positioned closer to a point P on which light on the light axis L of a corresponding one of the directional light source 26*a*, 26*b* is incident, and is set to be larger when the convex curved surface 29*a* is positioned more distant from the point P.

As shown in FIG. 6, an angle of light, which is incident on the micro reflector segment 29, and is reflected on and diffused from the convex curved surface 29*a* of the micro reflector segment 29, is smaller when the radius R of a circular arc defining the convex curved surface 29*a* is larger (a), and on the other hand, the angle is larger when the radius R of the circular arc defining the convex curved surface 29*a* is smaller (b) ($\alpha<\beta$ in the drawing). This relation is applied in a similar manner to the case of the convex spherical surface 29*b*.

The concave reflecting surface 20 of the reflector 12 according to the present invention has micro reflector segments 29 protruded therefrom in multiple stages and in multiple radial columns, the micro reflector segments 29 each having a convex curved surface 29*a* which is defined by a locus of a circular arc moved in parallel in a radial direction of the concave reflecting surface 20. The radius R of the convex curved surface 29*a*, in each of the reflection regions S1, S2, is set to be smaller when the convex curved surface 29*a* is positioned closer to a point P on which light emitted from each of the directional light sources 26*a*, 26*b* and traveling on the light axis L is incident, and on the other hand, is set to be larger when the convex curved surface is positioned more distant from the point P.

Accordingly, the light, which is emitted from the directional light sources 26*a*, 26*b*, travels on and around of the light axis L, and has strong intensity, is reflected on the convex curved surfaces 29*a* of the micro reflector segments 29, the surfaces each having a smaller radius R, and then diffused over a wide range (mainly diffused in a direction perpendicular to the locus of the parallel movement in the radial direction of the circular arc). On the other hand, the light which travels distant from the light axis L and has weak intensity is reflected on such convex curved surfaces 29*a* of the micro reflector segments 29, the surfaces each having a larger radius, and thus is not diffused over a wide range.

As a result, the light, which is emitted from the directional light sources 26*a*, 26*b*, travels on and around of the light axis L, and has strong intensity, can be diffused and incident on such portions, on an irradiation target surface A, that are dark since light is hardly incident thereon, or that receive only light having weak intensity in the case where a conventional reflector is used. In addition, light which travels at a wider angle relative to the light axis L, and has weak intensity is not diffused over a wide range, but is incident on portions of the irradiation target surface in the same manner as the conventional reflector. That is, the light emitted from the directional light sources 26*a*, 26*b* is incident on the whole irradiation target surface A approximately uniformly. A plurality of the reflection regions S1, S2 may be arranged on such a concave reflecting surface 20 that is an evenly and smoothly connected surface. However, as shown in FIGS. 8 and 9, the reflection regions S1, S2 may be arrange on such a concave reflecting surface 20 that is divided so as to correspond to the respective reflection regions and has irregularly connected surfaces. This is also applied to the other aspects of the present invention.

A second aspect of the present invention is different from the first aspect, in terms of the radius R of the convex curved surface 29*a*. That is, the reflector 12 for use in a light emitting device 10, comprises a concave reflecting surface 20 including a plurality of reflection regions S1, S2, which are arranged so as to correspond to a plurality of directional light sources 26*a*, 26*b*, each of whose light has maximum intensity when traveling on a light axis L, and has gradually decreased intensity when traveling at a wider angle relative to the light axis L: the concave reflecting surface 20 has micro reflector segments 29 protruded therefrom in multiple stages and in multiple radial columns, the micro reflector segments 29 each having a convex curved surface 29*a* which is defined by a locus of a circular arc moved in parallel in a radial direction of the concave reflecting surface 20; and the convex curved surface 29*a* has a radius R, in each of the reflection regions S1, S2, is set to be larger in a circumferential direction of the concave reflecting surface 20 when the convex curved surface 29*a* is positioned more distant from a point P on which light on the light axis L of a corresponding one of the directional light source 26*a*, 26*b* is incident, and is set to be uniformly in the radial direction of the concave reflecting surface 20.

In this case, since the radius R of each of the convex curved surfaces 29*a* in one radial column in the radial direction is set uniformly, a degree of diffusion of the light is not changed with respect to the radial column, even if a convex curved surface in the radial column is distant from the point P. Thus, the uniformity ratio of brightness on the irradiation target surface A is slightly lowered, but is practically allowable. That is, it is possible to design the reflector more easily.

A third aspect of the present invention is directed to a case where the micro reflector segment 29 has a convex spherical surface 29*b*, as shown in FIG. 2(*c*) or the like, which is obtained by defining an outer circumference of the micro reflector segment 29 with a line. A bottom surface (a surface on the concave reflecting surface 20) of the micro reflector segment 29 has a nearly rectangular trapezoid shape or a hexagon shape. According to the third aspect, a reflector 12 for use in a light emitting device 10, comprises a concave reflecting surface 20 including a plurality of reflection regions S1, S2, which are arranged so as to correspond to a plurality of directional light sources 26*a*, 26*b*, each of whose light has maximum intensity on its light axis L, and has gradually decreased intensity at a wider angle relative to the light axis L: the concave reflecting surface 20 has a large number of micro reflector segments 29, each having a convex spherical surface 29*b*, protruded therefrom; and a curvature of a surface of the convex spherical surface 29*b*, in each of the reflection regions S1, S2, is set to be smaller when the convex spherical surface 29*b* is positioned closer to a point P on which light on the light axis L of a corresponding one of the directional light source 26*a*, 26*b* is incident, and is set to be larger when the convex spherical surface 29*b* is positioned more distant from the point P.

In this case, unlike the first and second aspects, the light reflected on the convex spherical surface 29*b* is diffused not only in the circumferential direction but also in the radial direction, that is, in all directions. Thus, the degree of diffusion is increased. In other words, according to the first and second aspect, the light is diffused in a direction perpendicular to the locus of the parallel movement in the radial direction of the circular arc. On the other hand, in the present aspect, diffusion of the reflected light in such a direction is decreased. However, a curvature of the convex spherical surface 29*b* is set smaller when the same is closer to the point P, and thus, the uniformity ratio of the illuminance on the irradiation target surface A is slightly lowered, but is still maintained at a practically allowable level.

The shape of the convex spherical surface 29*b* is not limited to such a shape that is obtained by cutting a portion of a sphere, (a shape as shown in FIG. 2(*c*), or a shape that is obtained by bordering on outer circumferences of the micro reflector segments 29 with a line, as described later. An exemplary shape is a shape obtained by cutting a spheroid along its long axis (a shape similar to that of FIG. 2(*c*)), or a portion which is obtained by cutting the cut spheroid along lines which cross the focal points and are perpendicular to the long axis and by selecting the central cut portion (a shape having an outer appearance similar to that of FIG. 2(*b*), and in the case of being obtained from a spheroid, the shape is positioned such that its long axis direction is aligned with the radial direction). This point is applied to a fourth aspect of the present invention.

The fourth aspect of the present invention is different from the third aspect in terms of the curvature of the convex spherical surface 29*b*. That is, a reflector 12 for use in a light emitting device 10 comprises a concave reflecting surface 20 including a plurality of reflection regions S1, S2, which are arranged so as to correspond to a plurality of directional light sources 26*a*, 26*b*, each of whose light has maximum intensity on its light axis L, and has gradually decreased intensity at a wider angle relative to the light axis L: the concave reflecting surface 20 has a large number of micro reflector segments 29, each having a convex spherical surface 29*b*, protruded therefrom; and a curvature of a surface of the convex spherical surface 29*b*, in each of the reflection regions S1, S2, is set to be larger in a circumferential direction of the concave reflecting surface 20 when the convex spherical surface 29*b* is positioned more distant form a point P on which light on the light axis L of a corresponding one of the directional light source 26*a*, 26*b* is incident, and is set to be uniformly in the radial direction of the concave reflecting surface 20. In the same manner as the second aspect, since the degree of light diffusion is increased, the uniformity ratio of illumination on the target surface A is slightly lowered, but is still practically allowable.

According to the present invention, it is possible to provide a reflector for used in a light emitting device, and a light emitting device using the reflector, which are capable of significantly reducing a difference between the bright and the dark portions caused by the light distribution pattern on the irradiation target surface when light emitted from a plurality of directional light sources, and of improving a uniformity ratio of light intensity significantly or to a practically allowable level.

BRIEF DESCRIPTION OF THE DRAWINGS

FIG. 7 is a schematic diagram illustrating a state where the light emitting device according to the present invention is turned on;

DESCRIPTION OF THE PREFERRED EMBODIMENTS

Figure 1:
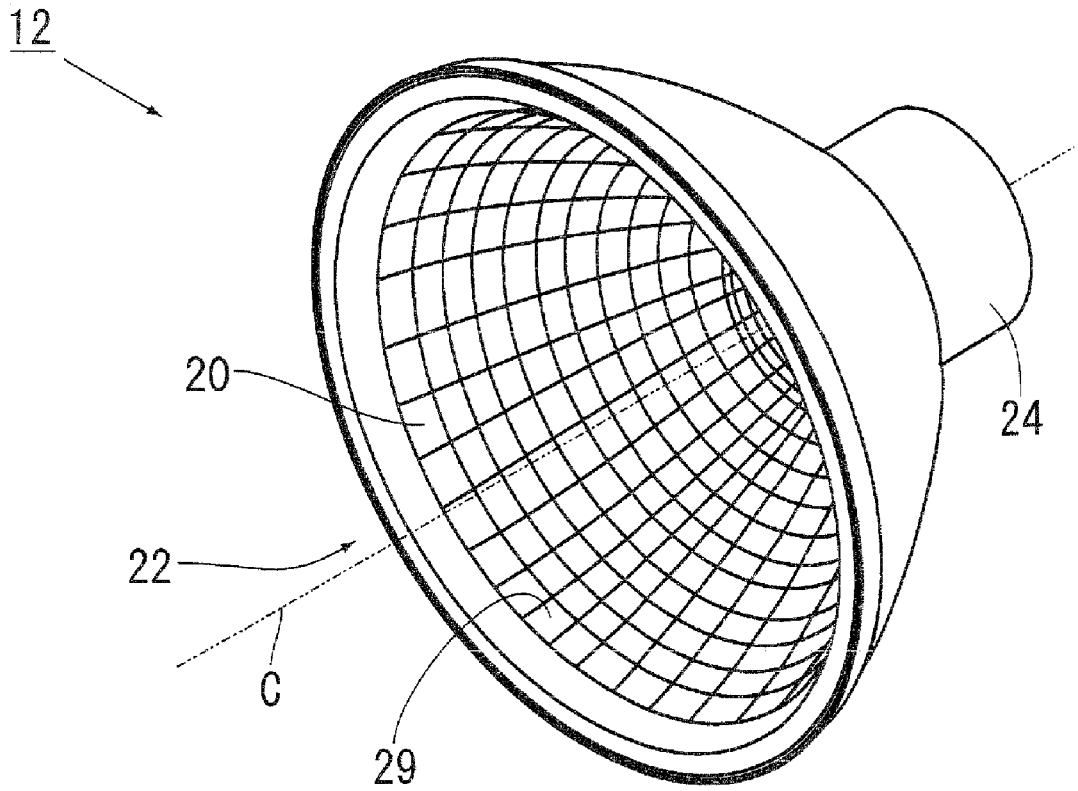
FIG. 1 is a perspective view showing a reflector according to the present invention.
Figure 2:
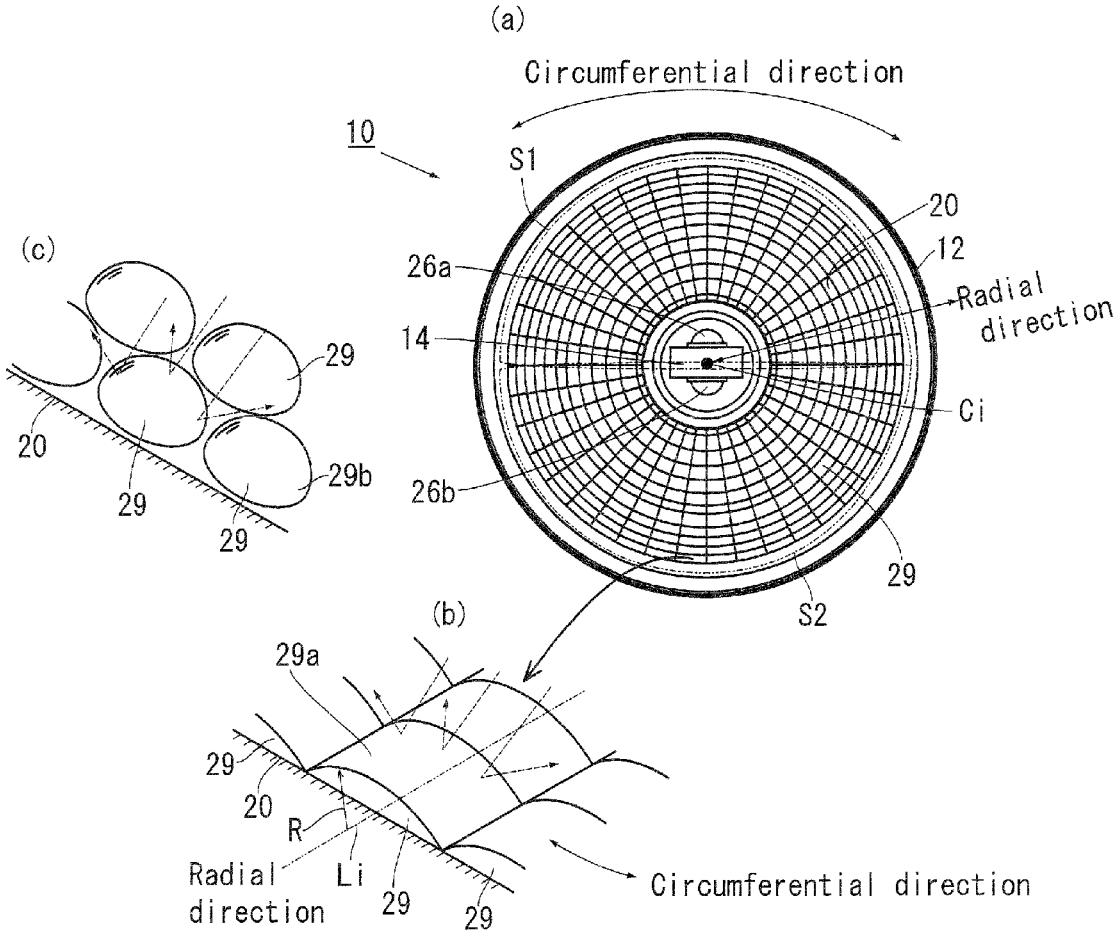
FIG. 2 is a diagram showing a shape of the reflector and micro reflector segments according to the present invention.
Figure 3:
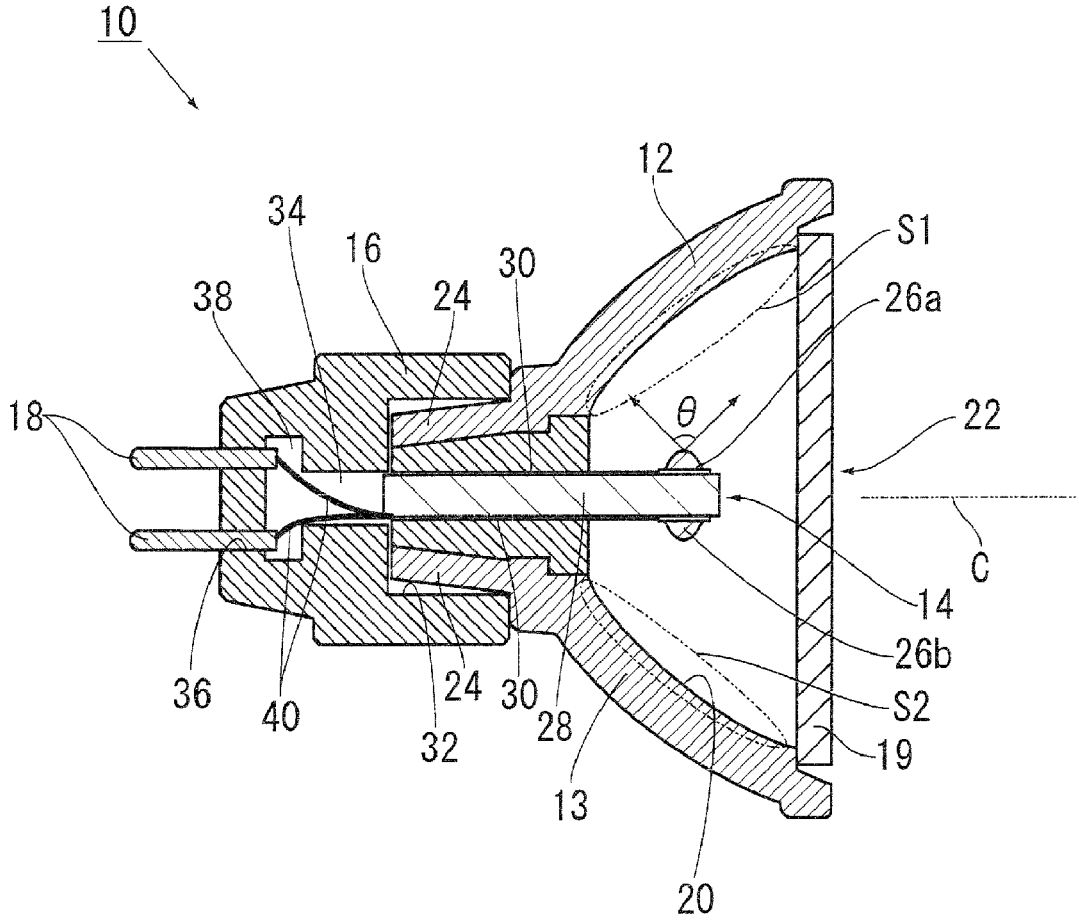
FIG. 3 is a cross-sectional view showing a light emitting device according to the present invention.

A light emitting device 10 according to the present invention is used for general illumination, a projector, and the like. As shown in FIG. 1 to FIG. 3, the light emitting device 10 includes a reflector 12, a light source unit 14 having LEDs 26*a* and 26*b* fixed thereto as two directional light sources 26*a* and 26*b*, a holder 16 holding the light source unit 14, feeder pins 18, and a front glass 19 (an acrylic board may be used, instead) which is fixed as needed basis.

The reflector 12 has: a concave reflecting surface 20; a light-emitting opening 22 through which light reflected on the concave reflecting surface 20 is output from the reflector 12; and a central fixing cylindrical portion 24 which has an approximately cylindrical shape, and is fixed into the holder 16 which is arranged on a side of the reflector 12, the side opposite to a side thereof having the light-emitting opening 22. A central axis C of the reflector 12 is a straight line which passes through the center of the reflector 12 and is perpendicular to the light-emitting opening 22. Glass, aluminum, and the like is used as a material of the reflector 12, and in the case of using aluminum, the reflecting surface is treated with metal deposition (or alumite treatment may be used, instead of the metal deposition). Further, the metal deposition using aluminum or the like may be used even in the case of using glass, and the concave reflecting surface 20 composed of an infrared-permeable film is generally formed on an inner surface of a main body of an umbrella shape. Particularly, in the light emitting device 10, as will be described later, since heat from the LED 26 is effectively radiated by a light source holder 28, such "resin" that is less heat-resistant compared to glass, aluminum, and the like, can be also used for the reflector 12.

Figure 8:
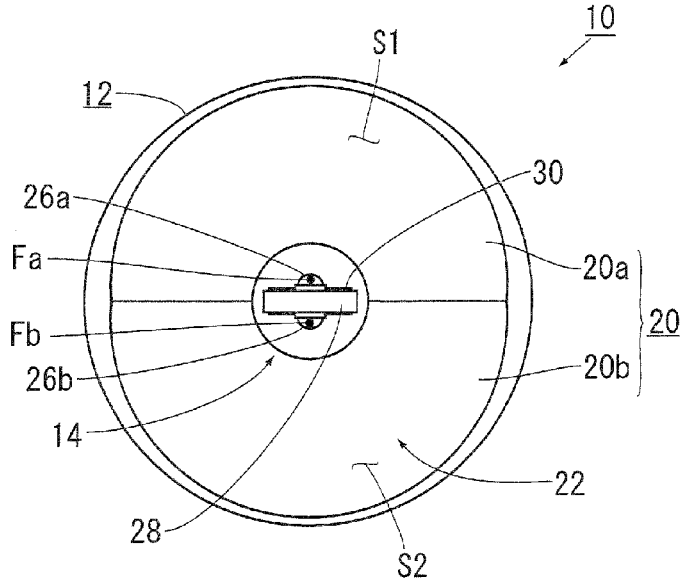
FIG. 8 is a diagram showing a modified example of the reflector according the present invention (in the case where a concave reflecting surface thereof is divided into two)
Figure 9:
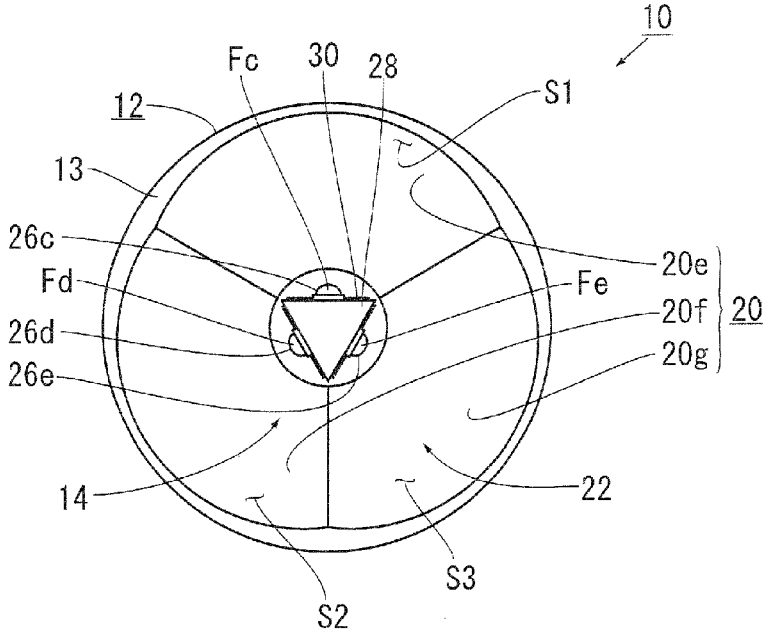
FIG. 9 is a diagram showing another modified example of the reflector according to the present invention (in the case where the concave reflecting surface thereof is divided into three)

The concave reflecting surface 20 including micro reflector segments 29 formed thereon is a concave surface that causes the light from the LEDs 26*a* and 26*b* to reflect toward an irradiation target surface A (not only a simple concave surface, but also a half body or a hemisphere face including one focal point of a paraboloid or a ellipsoid may be used. In the present embodiment, the paraboloid, which causes light incident thereon to reflect as parallel light, is preferable since it is possible to easily set and realize a high uniformity ratio with the use of the paraboloid). The concave reflecting surface 20 has two reflection regions S1 and S2 corresponding to the two LEDs 26*a* and 26*b*, respectively. Each of the reflection regions S1 and S2 may be formed by conceptually dividing one concave reflecting surface 20 into two reflection regions S1 and S2, as shown in the present embodiment. Alternatively, as described later, a concave reflecting surface 20 may be formed by combining a plurality of partial paraboloids as the reflection regions S1 and S2. The partial paraboloids are obtained by cutting portions of a paraboloid (FIGS. 8 and 9).

As shown in FIG. 2, the surface of the concave reflecting surface 20 is divided into multiple radial columns in a circumferential direction around a virtual center Ci, for example, when an inner bottom portion of the reflector 12 is viewed from the light-emitting opening 22 (in the present embodiment, equally divided into 40 radial columns at an interval of 9 degrees, i.e., 360 degrees/9 degrees=40, but the present invention is not limited to these values). Further, the same is divided, by concentric circles having the virtual center Ci as the center and having different radii, respectively, into multiple stages in a radial direction (in the present embodiment, divided into 11 stages, but the present invention is not limited to this value). In this manner, the surface is divided into multiple radial columns and multiple stages. Micro reflector segments 29 are formed on the divided surfaces (that is, in the present embodiment, 440(=40×11) micro reflector segments 29 are formed).

As shown in FIG. 2(*b*), each micro reflector segment 29 has a convex curved surface 29*a*, which is defined by a locus of a circular arc, having a predetermined radius R, moved in parallel in a radial direction of the concave reflecting surface 20 (for example, a shape that is obtained by cutting a cylindrical radial column having a predetermined radius R in parallel with its virtual central axis Li). A surface of the micro reflector segment 29 on the concave reflecting surface 20 is substantially of a nearly rectangular trapezoidal shape.

According to a method for arranging the micro reflector segments 29 (first embodiment), the radius R forming the convex curved surface 29*a* is set, in each of the reflection regions S1 and S2, to be larger when the segment is more distant, in a circumferential direction of the concave reflecting surface 20, from a point P on which the light emitted from each of the LEDs 26*a* and 26*b* and traveling on the light axis L is incident, and on the other hand, the radius R is set uniformly with respect to the radial direction of the concave reflecting surface 20. According to a method of second embodiment, which is described later, the radius R is set to be larger in the radial direction as well when the segment is more distant from the point P.

Figure 4:
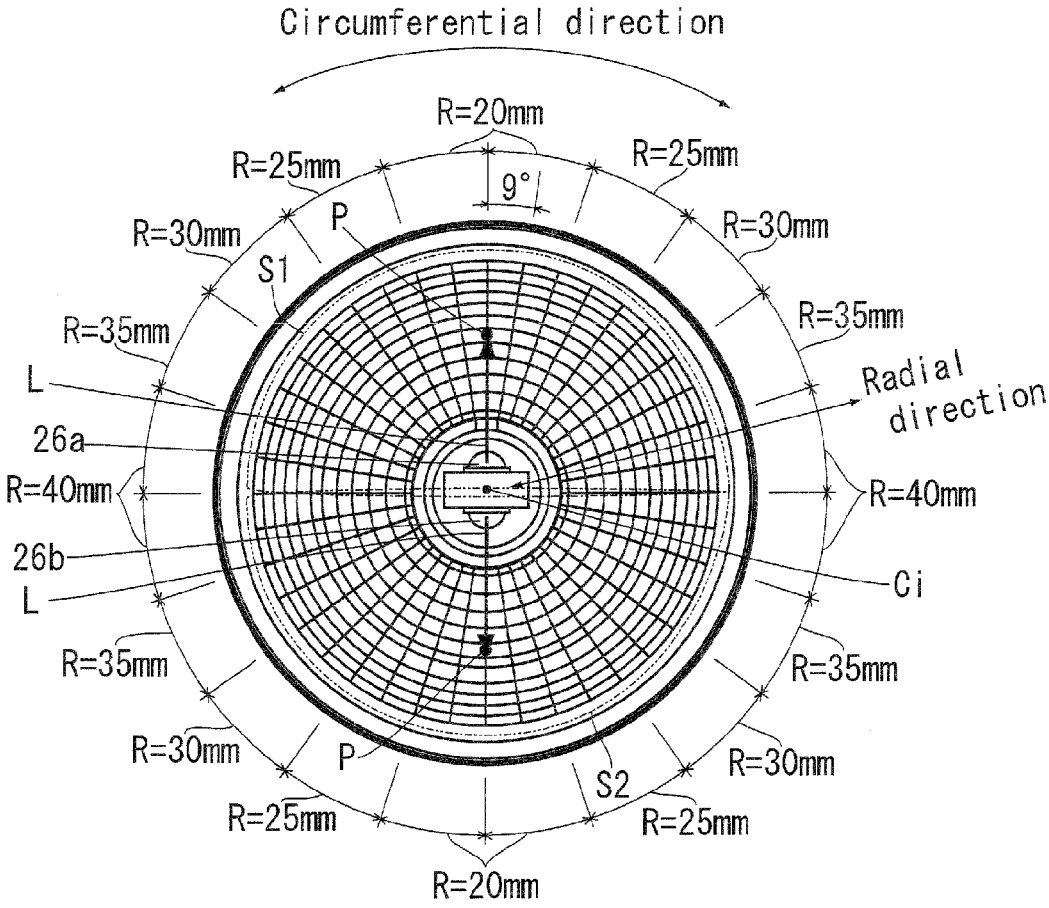
FIG. 4 is a schematic diagram illustrating radii of curvature surfaces of the micro reflector segments.

In this embodiment (FIG. 4), the radius R of the convex curved surface 29*a* of each micro reflector segment 29 is set at 20 mm, with respect to those micro reflector segments 29 which are located within a region formed by an angle of 18 degrees to both sides of the light axis L of the LED 26*a*, the region extending from the virtual center Ci of the reflector 12, as the center, toward a circumferential direction (that is, micro reflector segments 29 in respective two radial columns on both sides of the light axis L). With respect to those micro reflector segments 29 located within regions each formed by angles between 18 degrees and 36 degrees, the radius of each is set at 25 mm. In a similar manner, the radius of each micro reflector segment is set to 30 mm, 35 mm, and 40 mm, subsequently. The radius of each of the micro reflector segments 29 on the reflection region S2 corresponding to the LED 26*b* on the other side is also set in a similar manner, and a relation among radii R of the convex curved surfaces 29*a* of the respective micro reflector segments 29 is symmetric with respect a horizontal line running through the virtual center Ci.

The number and the shape of the micro reflector segments 29, and the radius R of each convex curved surface 29*a* are not limited to those examples described in the present embodiment. The number of the micro reflector segments 29 may be set to a desirable number by changing the number of times of division of the concave reflecting surface 20 in the circumferential direction and/or in the radial direction.

As another embodiment (a second embodiment) of the micro reflector segment 29, there may be a case where the curvature of each convex curved surface 29*a* is changed not only in the circumferential direction but also in the radial direction of the concave reflecting surface 20, in each of the reflection regions S1 and S2, so as to be set smaller when the convex curved surface 29*a* is closer to the point P on which the light emitted from each of the directional light sources 26*a* and 26*b* and traveling on the light axis L is incident, and so as to be set larger when the convex curved surface 29*a* is more distant from the point P. Accordingly, it is possible to control directivity of the light emitted from each of the LEDs 26*a* and 26*b* not only in the circumferential direction of the concave reflecting surface 20, but also in the radial direction. As a result, the reflected light toward the radial direction is slightly increased, and accordingly, the reflected light toward the circumferential direction is decreased. That is, the uniformity ratio of the illuminance on the irradiation target surface A is slightly lowered, but is still maintained at a practically allowable level.

Further, the shape of each micro reflector segment 29 is not limited to that of the first embodiment, but a shape of a convex spherical surface 29*b* (second embodiment) may be used instead of the convex curved surface 29*a*.

The shape of the convex spherical surface 29*b* is not limited to such a shape that is obtained by cutting a part of a spherical body (FIG. 2(*c*)), obtained by defining an outer circumference of each micro reflector segment 29 with a line. Instead, an applicable shape is such a shape that is obtained by cutting a spheroid along its long axis (i.e., a shape having an outer appearance similar to that shown in FIG. 2(*c*)), and a shape that is obtained by cutting the cut spheroid along lines perpendicular to the long axis and crossing the focal points of the spheroid and by selecting the central cut portion (i.e., a shape similar to FIG. 2(*b*), and if the shape is obtained from the spheroid, the shape is arranged such that the long axis direction is aligned with the radial direction). In other words, each convex spherical surface 29*b* has a smooth reflecting surface and a uniform curvature.

In this case, the curvature (or, the radius R in the case where the convex spherical surface 29*b* is of an approximately hemispherical shape) of the surface of the convex spherical surface 29*b*, in each of the reflection regions 51 and S2, may be set to be smaller when the convex spherical surface 29*b* is closer, in the circumferential direction and in the radial direction, to the point P on which the light emitted from each of the directional light sources 26*a* and 26*b* and traveling on the light axis L is incident, whereas the curvature may be set to be larger when the convex spherical surface 29*b* is more distant from the point P (the first exemplary arranging method). Alternatively, the curvature may be set to be larger when the convex spherical surface 29*b* is more distant from the point P in the circumferential direction of the concave reflecting surface 20, and, on the other hand, is set uniformly in the radial direction of the concave reflecting surface 20 (second exemplary arranging method).

Further, the curvature (or radius R) of the surface of each convex spherical surface 29*b* is not necessarily increased on a two radial column unit basis as like the present invention. Instead, the curvature may be increased for every radial column as the position of the convex spherical surface 29*b* is increasingly distant from light axis L. Alternatively, the curvature (or the radius R) may be increased on a three (or more) radial column unit basis. Further, the curvature (or the radius R) of the surface of the convex spherical surfaces 29*b* may be changed even in a single radial column in the radial direction.

The light source unit 14 includes the LEDs 26*a* and 26*b*, and a light source holder 28. The LEDs 26*a* and 26*b* are each a directional light source, and light therefrom has maximum intensity when traveling on the light axis L, and has gradually decreased intensity when traveling at a wider angle relative to the light axis L. The LEDs 26*a* and 26*b* are fixed on surfaces of one end of the light source holder 28. The LEDs 26*a* and 26*b* and the light source holder 28 are accommodated in an inner side of the reflector 12 so as to be aligned with the central axis C. Of course, any other directional light sources than the LEDs may be for use as the light source unit 14, however, the present specification is exemplified by the LEDs 26*a* and 26*b*.

Each of the LEDs 26*a* and 26*b* is a light emitting diode which emits light at a light emission angle θ of about 90° (the light emission angle θ is not limited thereto) when predetermined current is supplied thereto, and the two LEDs 26*a* and 26*b* emit light in opposing directions, respectively, toward the corresponding reflection regions S1 and S2 of the concave reflecting surface 20.

The number of the LEDs 26 is not limited to two, but three or more LEDs 26 may be used as described later.

Further, the irradiation surface exposed to the light from the LEDs 26*a* and 26*b* are preferably situated within ranges of reflection regions S1 and S2, and in such a case, nearly the whole light from the LEDs 26 can be reflected toward the irradiation target surface A, and thus it is possible to minimize generation of glare (which is light from the LEDs 26 and significantly deviated from the irradiation target surface and accordingly providing undesirable glare to those who are in the surrounding area).

In order to set the irradiation surface exposed to the light from the LEDs 26*a* and 26*b* within the ranges of the reflection regions S1 and S2, the following matters needs to be considered, i.e., the light emission angle θ of each of the LEDs 26*a* and 26*b*, a size of each of the reflection regions S1 and S2, and a distance from each of the LEDs 26*a* and 26*b* to each of the reflection regions S1 and S2. That is, when the light emission angle θ is larger, or when the distance from each of the LEDs 26*a* and 26*b* to each of the corresponding reflection regions S1 and S2 is longer, the size of each of the reflection regions 51 and S2 needs to be increased. On the other hand, when the light emission angle θ is smaller, or when the distance from each of the LEDs 26*a* and 26*b* to each of the corresponding reflection regions S1 and S2 is smaller, then the size of each of the reflection regions S1 and S2 needs to be small.

The light source holder 28 (FIG. 1 to FIG. 3) is formed of a bonded plywood such as a silicon substrate and a printed circuit board, a copper plate, an aluminum plate, or the like, which is of a strip shape, and is designed to hold the LEDs 26*a* and 26*b* at a predetermined position in the inner side of the reflector 12. In the present embodiment, the light source holder 28 is formed by attaching a glass epoxy board to both sides of an aluminum plate or a copper plate which is used as a core. On a front and a rear surfaces of one end, i.e., free end, of the light source holder 28, a pair of LEDs 26*a* and 26*b* are mounted such that backsides (surfaces opposite to light emitting surfaces) thereof face each other.

Further, feeder circuits 30 are formed on the front and the back surfaces of the light source holder 28, and electric power is supplied to the LEDs 26*a* and 26*b* through the feeder circuits 30 (in the case of the aluminum plate, the LEDs 26*a* and 26*b* and the aluminum plate are electrically insulated, and the electric power is supplied to the LEDs 26*a* and 26*b* through a conductive wire).

Still further, the light source holder 28 is formed of a high thermal conductive material such as the above-described silicon substrate, the printed circuit board, the aluminum plate, and the like, and is capable of receiving heat generated from the LEDs 26*a* and 26*b* when the LEDs 26*a* and 26*b* are turned on.

That is, the light source holder 28 not only holds the LEDs 26*a* and 26*b*, but also supplies the electric power to the LEDs 26*a* and 26*b*. In addition, the light source holder 28 functions as a heat sink for the LEDs 26*a* and 26*b*. The other end of the light source holder 28 is inserted to the central fixing cylindrical portion 24 of the reflector 12, and bonded to the reflector 12 with an inorganic adhesive or the like (a method for fixing being described later in detail). The electric power is supplied to the feeder circuits 30 from the feeder pins 18 through the lead wires 40.

The holder 16 is formed of a heat-resistant material such as ceramics and is of a cylinder-like shape. As shown in FIG. 3, one end face of the holder 16 has a reflector receiving groove 32 so as to allow the central fixing cylindrical portion 24 of the reflector 12 to be fitted thereinto. The other end face of the holder 16 has feeder pin receiving holes 36 so as to allow the feeder pins 18 to be fitted thereinto, and a lead wire insertion hollow 38 so as to allow the lead wires 40 (to be described later) to be inserted therethrough. Further, a communicating hole 34, which allows mutual communication between the reflector receiving groove 32 and the lead wire insertion hollow 38, is arranged such that the feeder circuits 30 arranged on both of the front and the back surfaces of the light source holder 28 are connected to the lead wires 40. Still further, the reflector 12 and the feeder pins 18 are fitted into the holder 16, and bonded to the holder 16 with an inorganic adhesive or the like. As the inorganic adhesive, an alumina-silica ($Al_2O_3$—$SiO_2$) type, an alumina ($Al_2O_3$) type, or a silicon carbide (SiC) type inorganic adhesive may be applied. Further, in the case where a temperature of the LEDs 26 during emitting light is relatively low, epoxy resin may be used as the adhesive.

The feeder pins 18 are electrodes that receive power from the outside, and one end of each lead wire 40 is electrically connected to an end of each of the pins 18, and the other end of each lead wire 40 is electrically connected, through the lead wire insertion hollow 38 and the communicating hole 34 of the holder 16, to each feeder circuit 30 provided on the light source holder 28.

The light emitting device 10 is, for example, manufactured in accordance with the following procedure. The LEDs 26*a* and 26*b* are bonded onto the light source holder 28, and electrically connected to the feeder circuits 30, whereby the light source unit 14 is assembled. The assembled light source unit 14 is fitted into the central fixing cylindrical portion 24 of the reflector 12, and fixed at a predetermined position with the use of an inorganic adhesive or the like. Further, the holder 16 having the feeder pins 18 fitted into one end face thereof is arranged. The feeder pins 18 and the light source holder 28 are electrically connected with each other through the lead wires 40, and the holder 16 is fixed with the central fixing cylindrical portion 24.

When the electric power is supplied to the feeder pins 18 of such manufactured light emitting device 10, the electric power is supplied to the LEDs 26*a* and 26*b* through the lead wires 40, and to the feeder circuits 30 arranged on the light source holder 28, and then the LEDs 26*a* and 26*b* emit light. The light emitted from the LEDs 26*a* and 26*b* is reflected, respectively, in the corresponding reflection regions S1 and S2 of the concave reflecting surface 20, and is outputted from the light emitting device 10 through the light-emitting opening 22.

Figure 5:
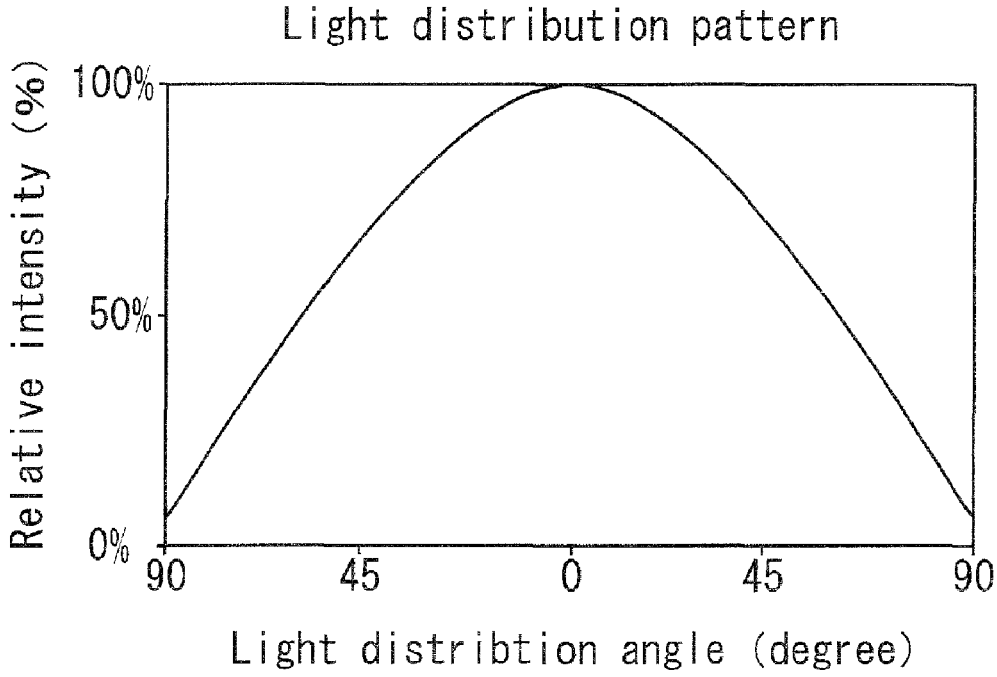
FIG. 5 is a diagram showing a distribution pattern of light emitted from a generally-used LED.

Generally, as shown in FIG. 5, each of the LEDs 26*a* and 26*b* is each a directional light source whose light has maximum intensity when traveling on the light axis L (that is, in case of light distribution angle=0 degrees), and has smaller intensity when traveling at a wider angle relative to the light axis L.

Figure 6:
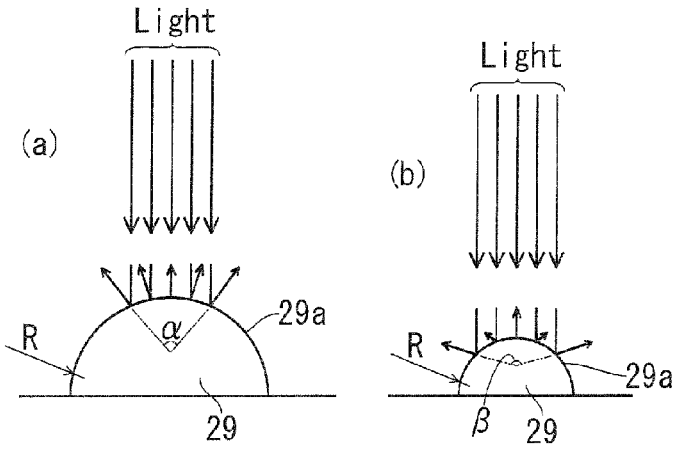
FIG. 6 is a schematic diagram showing a difference of a light diffusion angle between a case of a curvature surface having a large radius (a) and a case of a curvature surface having a small radius (b)

Further, when the light incident on the micro reflector segment 29 is reflected on and diffused from the convex curved surface 29*a* of the micro reflector segment 29, as shown in FIG. 6, an angle of the diffusion is smaller in the case (a) where a radius R of the circular arc defining the convex curved surface 29*a* is larger, and on the other hand, the angle of the diffusion is larger in the case (b) where the radius R of the circular arc defining the convex curved surface 29*a* is smaller ($\alpha<\beta$ in the drawing). The same is applicable to the case of the convex spherical surface 29*b* instead of the convex curved surface 29*a*.

On the concave reflecting surface 20 of the reflector 12 according to the present embodiment, micro reflector segments 29, each of which has the convex curved surface 29*a* defined by a locus of a circular arc moved in parallel in the radial direction of the concave reflecting surface 20, are convexly arranged in multiple stages and in multiple radial columns. The radius R of each convex curved surface 29*a* is set, in each of the reflection regions S1 and S2, to be larger when the convex curved surface 29*a* is more distant, in the circumferential direction of the concave reflecting surface 20, from the point P on which the light emitted from each of the directional light sources 26*a* and 26*b* and traveling on the light axis L is incident. In the radial direction of the concave reflecting surface 20, the radius R is set uniformly.

Figure 7:
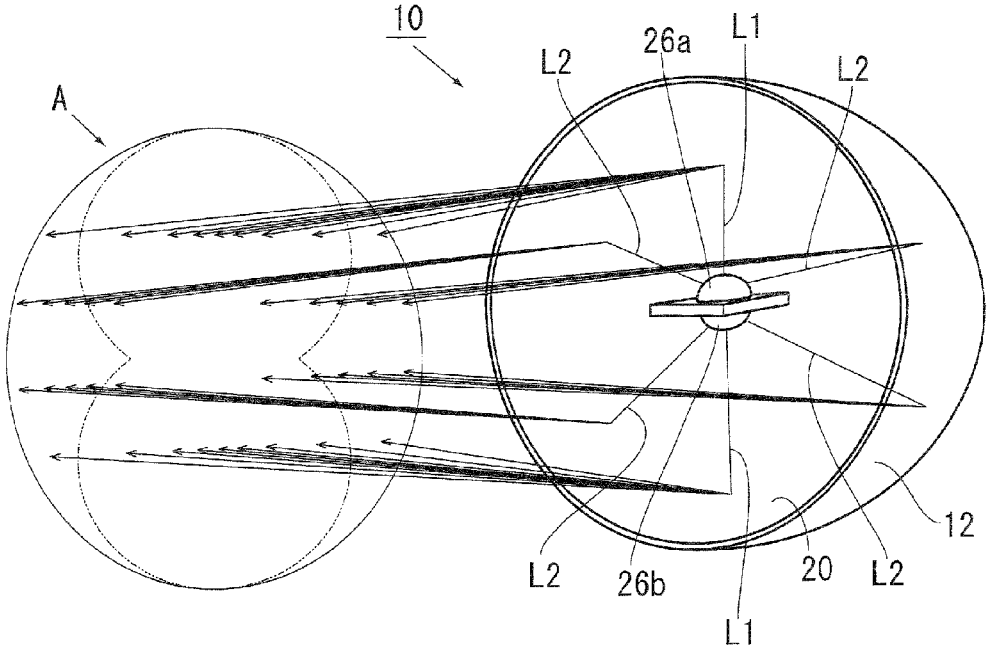

Accordingly, as shown in FIG. 7, in the case of the example in FIG. 2(*b*), the light having strong intensity, which is emitted from each of the LEDs 26*a* and 26*b* and travels on and in the vicinity of the light axis L, is diffused over a wide range since the light is mainly reflected on the convex curved surfaces 29*a* of the micro reflector segments 29, the convex curved surfaces 29*a* each having a small radius R. On the other hand, the light having weak intensity, which travels distant from the light axis L is reflected on the convex curved surfaces 29*a* of the micro reflector segments 29, the convex curved surfaces 29*a* each having a large radius R, and thus the light having the weak intensity is diffused mainly in the circumferential direction, but not widely.

As a result, the light, which has strong intensity, is emitted from the LEDs 26*a* and 26*b*, and travels on and in the vicinity of the light axis L, can be diffused and incident on such portions, on the irradiation target surface A, that are dark since light is hardly incident thereon, or that receive only light having weak intensity in the case where the conventional reflectors is used. In addition, the light, which travels at a wider angle relative to the light axis L and has weak intensity, is not diffused over a wide range, but is incident on portions of the irradiation target surface in the same manner as the conventional reflector. As a result, the light from the LEDs 26*a* and 26*b* irradiates the whole irradiation target surface A substantially uniformly.

Thus, according to the present embodiment, it is possible to provide a reflector 12 for use in a light emitting device 10, and a light emitting device 10 using the same, which are capable of minimizing the difference between bright and dark portions caused by the light distribution pattern on the irradiation target surface A when the light emitted from a plurality of LEDs 26*a* and 26*b* is reflected, and also capable of significantly improving the uniformity ratio of illuminance on the irradiation target surface A.

In the above embodiment, one concave reflecting surface 20 is abstractly divided into two reflection regions S1 and S2. However, as shown in FIG. 8 and FIG. 9, a concave reflecting surface 20 having an irregular surface may be formed by combining a plurality of partial paraboloids as the reflection regions S1 and S2 (a third and a fourth examples).

The example shown in FIG. 8 will be described where the concave reflecting surface 20 is formed by combining two of the partial paraboloids as the reflection regions S1 and S2. Each of the reflection regions S1 and S2 is arranged so as to be slightly displaced to the outside of the main body 13 of the reflector 12 in the radial direction. Partial paraboloids 20*a* and 20*b* are arranged on the reflection regions S1 and S2, respectively. The partial paraboloids 20*a* and 20*b* are obtained by partially cutting a paraboloid. Each of the LEDs 26*a* and 26*b* is located at focal points Fa and Fb of the partial paraboloids 20*a* and 20*b*, respectively. In the example shown in the drawing, the reflection regions S1 and S2 have a same size and are paired up with each other. The partial paraboloids 20*a* and 20*b* constitute the whole of the reflection regions S1 and S2, respectively. That is, the concave reflecting surface 20 is formed by arranging a pair of paraboloids 20*a* and 20*b* having a same size so as to face each other. A boundary area between the paraboloids 20*a* and 20*b* has an irregular surface. Depending on the application of the light emitting device 10 or the shape of the irradiation surface, the size of the reflection regions S1 and S2 may be different from each other, or the partial paraboloids 20*a* and 20*b* may be formed on main reflecting surfaces located at central portions of the reflection regions S1 and S2. Further, the boundary area between the reflection regions S1 and S2 is not necessarily an irregular surface, but may be formed to be a smooth curved surface or a planar surface.

FIG. 9 shows an example of the concave reflecting surface 20 which is divided into three. In this case, the light emitting device 10 has three LEDs 26*c*, 26*d*, and 26*e*, and the LEDs 26*c*, 26*d*, and 26*e* are located at focal points Fc, Fd, and Fe of partial paraboloids 20*c*, 20*d*, and 20*e* (=reflection regions S1, S2, and S3). The three LEDs 26*c*, 26*d*, and 26*e* emit light toward the partial paraboloids 20*c*, 20*d*, and 20*e*, respectively.

Moreover, when the concave reflecting surface 20 is formed by combining a plurality of partial paraboloids, each of the LEDs 26*a*, 26*b* is not necessarily located at each of the focal point Fa, Fb, and the like of the partial paraboloids 20*a*, 20*b*. Instead, the focal point Fa, Fb, and the like may be arranged to be located on the light axis L of each of the LEDs 26*a*, 26*b*.

Figure 10:
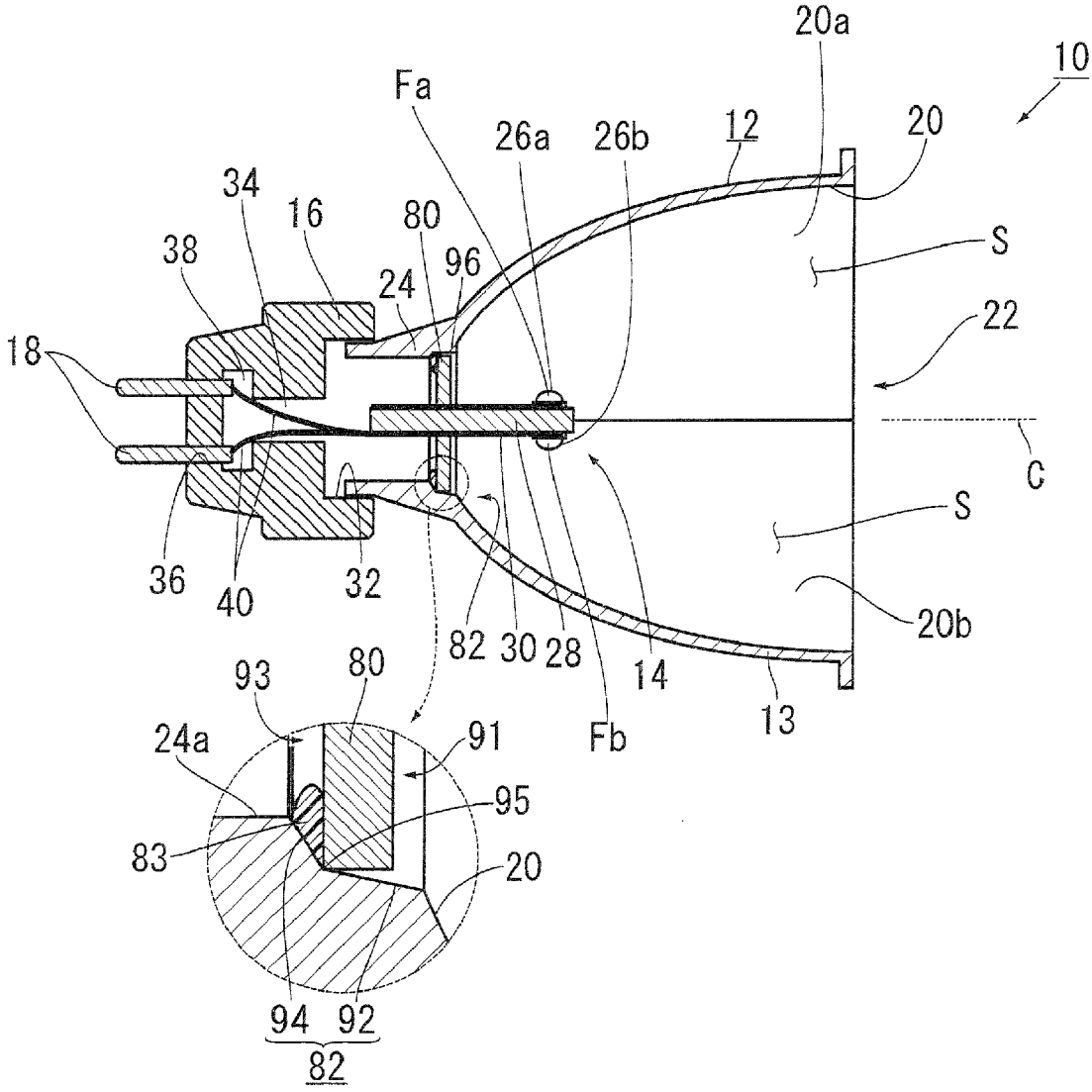
FIG. 10 is a cross-sectional view showing another embodiment relating to a method for fixing a LED holder.
Figure 11:
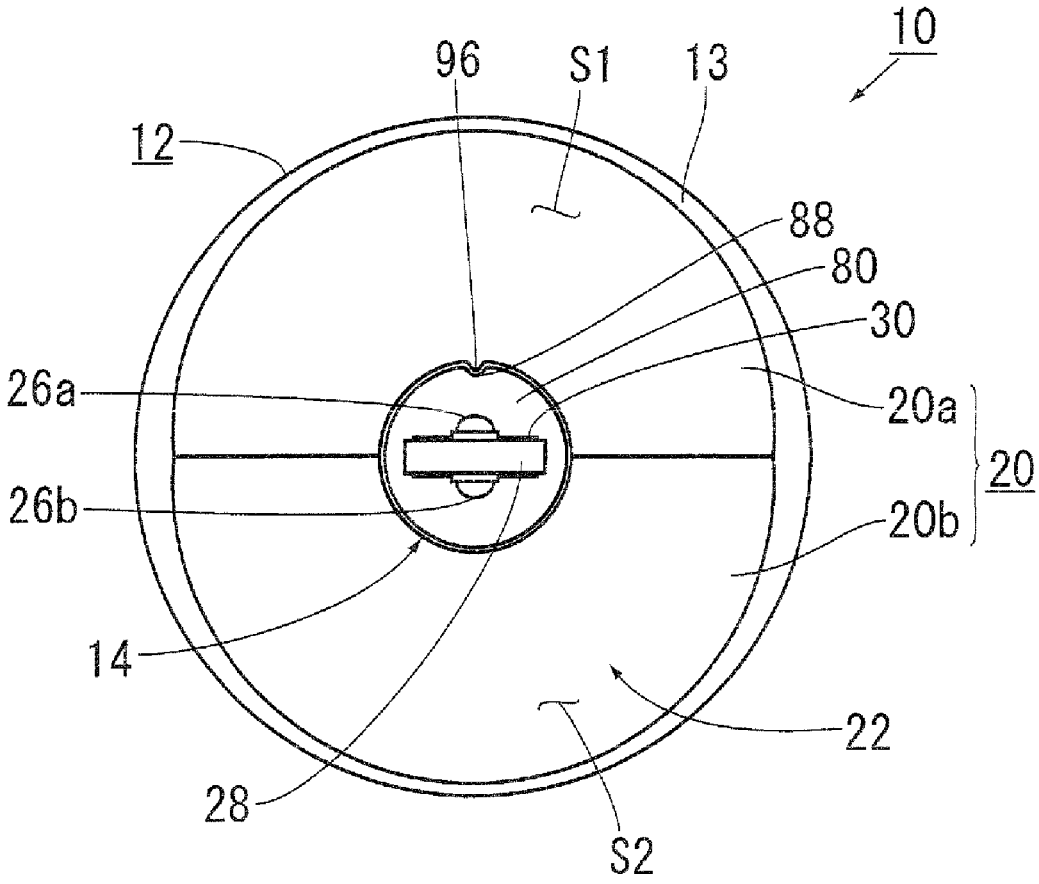
FIG. 11 is a diagram showing another embodiment relating to a method for fixing the LED holder.

In the above embodiment, the light source holder 28 is bonded to and fixed with the central fixing cylindrical portion 24 of the reflector 12 with the use of an inorganic adhesive, however, the method for fixing the light source holder 28 is not limited thereto. For example, as shown in FIGS. 10 and 11, the light source holder 28 is fixed into a central portion of a disk-like shaped flange 80. The flange 80 is fitted into a light source holder fixing portion 82, which is arranged at a bottom portion of the concave reflecting surface 20 of the reflector 12, and then the flange 80 is fixed with the light source holder fixing portion 82 with the use of an adhesive 83, whereby the light source holder 28 can be fixed with the reflector 12. In FIGS. 10 and 11, the above described method for fixing the light source holder 28 is applied to a case where the concave reflecting surface 20 is divided into two reflection regions S1 and S2, and the same fixing method can be applied to a case where the concave reflecting surface 20 is not divided into, or to a case where the concave reflecting surface 20 is divided into three or more.

Figure 12:
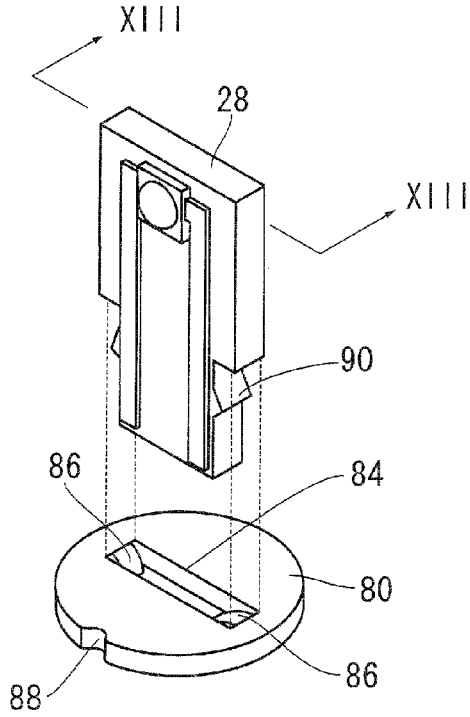
FIG. 12 is an exploded perspective view showing the LED holder and a flange.
Figure 13:
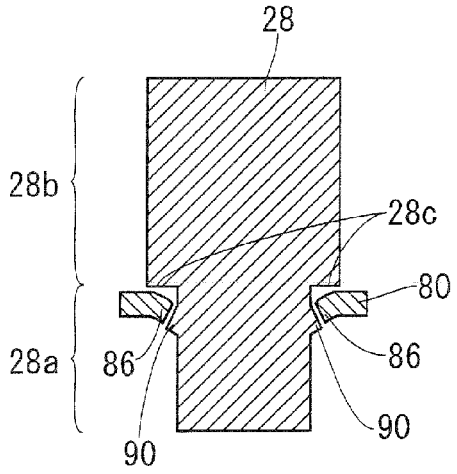
FIG. 13 is a cross-sectional view taken on line XIII-XIII of FIG. 12.
Figure 14:
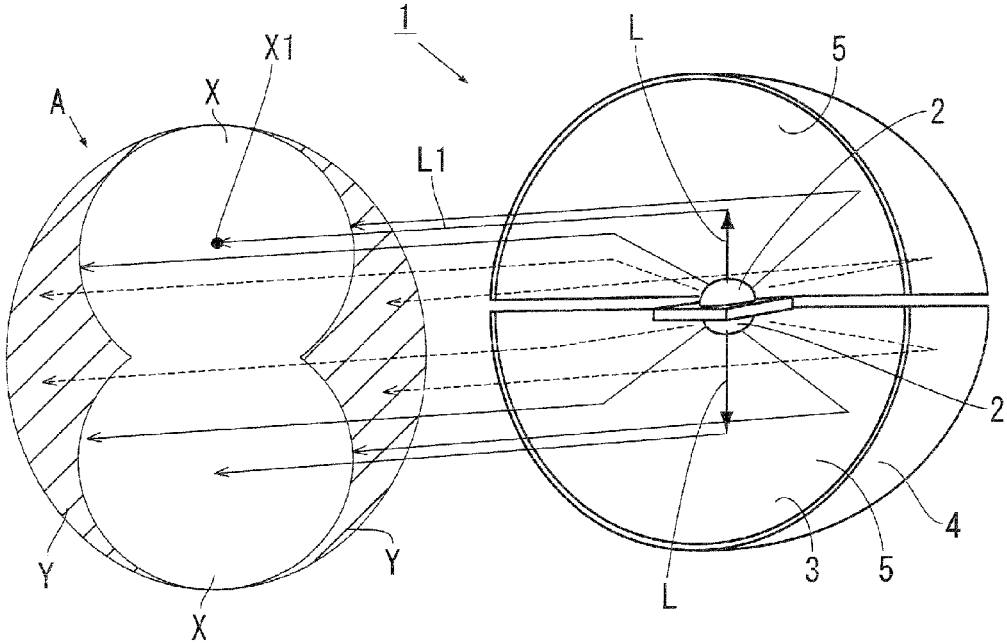
FIG. 14 is a diagram showing a conventional art.

As shown in FIGS. 12 and 13, at a central portion of the flange 80, a light source holder receiving hole 84, which is of a rectangular shape as viewed from a planar surface, is arranged so as to be fitted a lower end of the light source holder 28 thereinto. On short sides of the light source holder receiving hole 84, the sides facing each other, a pair of bent-low pieces 86 are formed so as to extend obliquely downward. Moreover, on a circumference side of the flange 80, a positioning hollow 88 is formed so as to receive a positioning projection 96 (to be described later) arranged in the light source holder fixing portion 82.

The light source holder 28 of the present embodiment has a lower portion 28*a* and an upper portion 28*b*, and the latter is wider than the former. The lower portion 28*a* is fitted into the light source holder receiving hole 84 of the flange 80. Moreover, steps 28*c* are formed between the lower portion 28*a* and the upper portion 28*b*, and on both sides of the lower portion 28*a*, flange member fixing protrusions 90 are formed which cause, together with the bent-low pieces 86 of the flange 80, the flange 80 to be fixed with the light source holder 28 when the lower portion 28*a* of the light source holder 28 is inserted into the light source holder receiving hole 84 until the flange 80 abuts on the steps 28*c* of the light source holder 28.

The light source holder fixing portion 82 (FIG. 10) is constituted of a flange insertion portion 92 and a reduced diameter portion 94. The flange insertion portion 92 is disposed between an inner space of the reflector 12 and an inner space of the central fixing cylindrical portion 24, and is open toward the side of the inner space of the reflector 12. The diameter of the flange insertion portion 92 is reduced gradually toward the central fixing cylindrical portion 24. In the flange insertion portion 92, a flange insertion space 91 of a conical frustum shape is formed so as to be fitted the flange 80 thereinto. The reduced diameter portion 94 is connected with an end portion (connection portion 95) of the flange insertion portion 92, the end portion being situated on the side of the central fixing cylindrical portion, and the diameter thereof is increasingly reduced toward the central fixing cylindrical portion 24 compared to that of the flange insertion space 91, whereby a reduced diameter space 93 of a conical frustum shape is formed. Further, the flange insertion portion 92 of the light source holder fixing portion 82 has a positioning projection 96 so as to be fitted together with the positioning hollow 88 of the flange 80.

The diameter of the flange 80 is set such that a circumference of the lower surface of the flange 80 fitted into the flange insertion portion 92 abuts on the connection portion 95 where the flange insertion portion 92 and the reduced diameter portion 94 are connected with each other.

According to the present embodiment, the flange 80 is fixed with the light source holder 28, the positioning hollow 88 of the flange 80 is fitted together with the positioning projection 96 of the light source holder fixing portion 82, and the flange 80 is inserted and fitted into the flange insertion portion 92 until the circumference of the lower surface of the flange 80 abuts on the connection portion 95. Accordingly, the position of the flange 80 in the inner space of the reflector 12 is uniquely determined, and the position of each of the LEDs 26*a* and 26*b* fixed on the light source holder 28 in the inner space of the reflector 12 is also determined uniquely.

In other words, when a distance from the LEDs 26*a* and 26*b* to the lower surface of the flange 80, and the position of the positioning hollow 88 are determined appropriately in advance, it is possible to easily and accurately determine the position of each of LEDs 26*a* and 26*b* to be at a predetermined position in the concave reflecting surface 20 (e.g., at the focal points Fa and Fb of the partial paraboloids 20*a* and 20*b*) only by causing the positioning hollow 88 and the positioning projection 96 to correspond to each other, and by fitting the flange 80 and the flange insertion portion 92 together.

As above described, the light source holder fixing portion 82 has the reduced diameter portion 94 which forms the conical frustum-shaped reduced diameter space 93 on the side of the central fixing cylindrical portion 24 from the flange insertion portion 92. Accordingly, when the flange 80 is fitted into the flange insertion portion 92, the reduced diameter space 93 is definitely secured between the lower surface of the flange 80 and the surface of the reduced diameter portion 94. Thus, an adhesive 83 enters the reduced diameter space 93, and is sandwiched between the lower surface of the flange 80 and the surface of the reduced diameter portion 94, and consequently, it is possible to fix the light source holder fixing portion 82 with the flange 80 in an ensured manner.

The disclosure of Japanese Patent Application No. 2008-313403 filed Dec. 9, 2008 including specification, drawings and claims is incorporated herein by reference in its entirety.

Although the invention has been described in its preferred form with a certain degree of particularity, it is understood that the present disclosure of the preferred from has been changed in the details of construction and the combination and arrangement of parts may be resorted to without departing from the spirit and scope of the invention as hereinafter claimed.

What is claimed is:

1. A reflector for use in a light emitting device, comprising:

a concave reflecting surface including a plurality of reflection regions, which are arranged so as to correspond to a plurality of directional light sources, each of whose light has maximum intensity on its light axis, and has gradually decreased intensity at a wider angle relative to the light axis, wherein:

the concave reflecting surface has micro reflector segments protruded therefrom in multiple stages and in multiple radial columns, the micro reflector segments each having a convex curved surface which is defined by a locus of a circular arc moved in parallel in a radial direction of the concave reflecting surface; and a radius of the circular arc of the convex curved surface, in each of the reflection regions, is set to be smaller when the convex curved surface is positioned closer to a point on which light on the light axis of a corresponding one of the directional light source is incident, and is set to be larger when the convex curved surface is positioned more distant from the point.

2. A reflector for use in a light emitting device, comprising:

a concave reflecting surface including a plurality of reflection regions, which are arranged so as to correspond to a plurality of directional light sources, each of whose light has maximum intensity on its light axis, and has gradually decreased intensity at a wider angle relative to the light axis, wherein:

the concave reflecting surface has micro reflector segments protruded therefrom in multiple stages and in multiple radial columns, the micro reflector segments each having a convex curved surface which is defined by a locus of a circular arc moved in parallel in a radial direction of the concave reflecting surface; and a radius of the circular arc of the convex curved surface, in each of the reflection regions, is set to be larger in a circumferential direction of the concave reflecting surface when the convex curved surface is positioned more distant from a point on which light on the light axis of a corresponding one of the directional light source is incident, and is set to be uniformly in the radial direction of the concave reflecting surface.

3. A reflector for use in a light emitting device, comprising:

a concave reflecting surface including a plurality of reflection regions, which are arranged so as to correspond to a plurality of directional light sources, each of whose light has maximum intensity on its light axis, and has gradually decreased intensity at a wider angle relative to the light axis, wherein:

the concave reflecting surface has micro reflector segments, each having a convex spherical surface, protruded therefrom; and a curvature radius of a surface of the convex spherical surface, in each of the reflection regions, is set to be smaller when the convex spherical surface is positioned closer to a point on which light on the light axis of a corresponding one of the directional light source is incident, and is set to be larger when the convex spherical surface is positioned more distant from the point.

4. A reflector for use in a light emitting device, comprising:

a concave reflecting surface including a plurality of reflection regions, which are arranged so as to correspond to a plurality of directional light sources, each of whose light has maximum intensity on its light axis, and has gradually decreased intensity at a wider angle relative to the light axis, wherein:

the concave reflecting surface has micro reflector segments, each having a convex spherical surface, protruded therefrom; and a curvature radius of a surface of the convex spherical surface, in each of the reflection regions, is set to be larger in a circumferential direction of the concave reflecting surface when the convex spherical surface is positioned more distant from a point on which light on the light axis of a corresponding one of the directional light source is incident, and is set to be uniformly in a radial direction of the concave reflecting surface.

5. A light emitting device, comprising: the reflector according to claim 1; and the plurality of directional light sources, respectively irradiating the reflection regions of the reflector.

6. A light emitting device, comprising: the reflector according to claim 2; and the plurality of directional light sources, respectively irradiating the reflection regions of the reflector.

7. A light emitting device, comprising: the reflector according to claim 3; and the plurality of directional light sources, respectively irradiating the reflection regions of the reflector.

8. A light emitting device, comprising: the reflector according to claim 4; and the plurality of directional light sources, respectively irradiating the reflection regions of the reflector.

* * * * *